US005170768A

United States Patent [19]

Eileraas

[11] Patent Number: 5,170,768

[45] Date of Patent: Dec. 15, 1992

[54] MODULAR TWIN TOWER DISTRIBUTORLESS IGNITION COIL

[75] Inventor: Eric K. Eileraas, Chicago, Ill.

[73] Assignee: Ford Motor Company, Dearborn, Mich.

[21] Appl. No.: 811,736

[22] Filed: Dec. 23, 1991

[51] Int. Cl.[5] ..... F02P 3/02; H01R 13/02; H01T 13/04

[52] U.S. Cl. ..... 123/634; 336/96; 336/107

[58] Field of Search ..... 123/634, 635, 643, 647; 336/92, 96, 98, 107

[56] References Cited

U.S. PATENT DOCUMENTS

| | | | |
|---|---|---|---|
| 3,949,338 | 4/1976 | Burson | 336/92 |
| 4,763,094 | 8/1988 | Kojima | 336/92 |
| 4,831,995 | 5/1989 | Biton | 123/635 |
| 4,834,056 | 5/1989 | Kawai | 123/634 |
| 4,903,675 | 2/1990 | Huntzinger et al. | 123/635 |
| 4,933,809 | 6/1990 | Boede et al. | 361/395 |
| 4,951,641 | 8/1990 | Takaishi et al. | 123/634 X |
| 4,986,249 | 1/1991 | Nakamura | 123/635 |
| 5,109,828 | 5/1992 | Tagami et al. | 123/635 |
| 5,125,386 | 6/1992 | De Filippis et al. | 123/634 |

FOREIGN PATENT DOCUMENTS

| | | | |
|---|---|---|---|
| 3920080 | 1/1991 | Fed. Rep. of Germany | 123/635 |
| 92576 | 4/1989 | Japan | 123/635 |

*Primary Examiner*—Willis R. Wolfe

*Attorney, Agent, or Firm*—Roger L. May; Richard D. Dixon

[57] ABSTRACT

A modular twin tower distributorless ignition coil assembly for an internal combustion engine includes a plurality of ignition coil subassemblies having a molded housing, a primary winding, a secondary winding, a laminated steel-plated armature, primary winding connectors and two high voltage towers for delivering the high voltage impulse induced by the secondary coil to respective engine spark plugs. Multiple ignition coil subassemblies can be coupled together through the use of integrally molded receptacle and plug connectors contained on the housing which ultimately co-operate with an engine control module to fire two, four, six or eight cylinder engines. Each modular ignition coil subassembly is substantially identical in its overall configuration and only minor modifications to the ignition coil subassembly are required to tailor an individual ignition coil assembly to fit into its position in a series of modules.

3 Claims, 3 Drawing Sheets

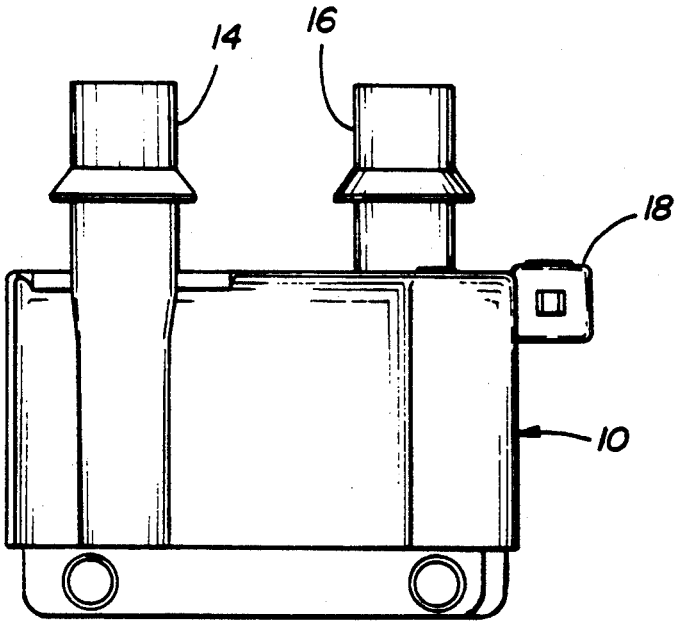
Fig-2
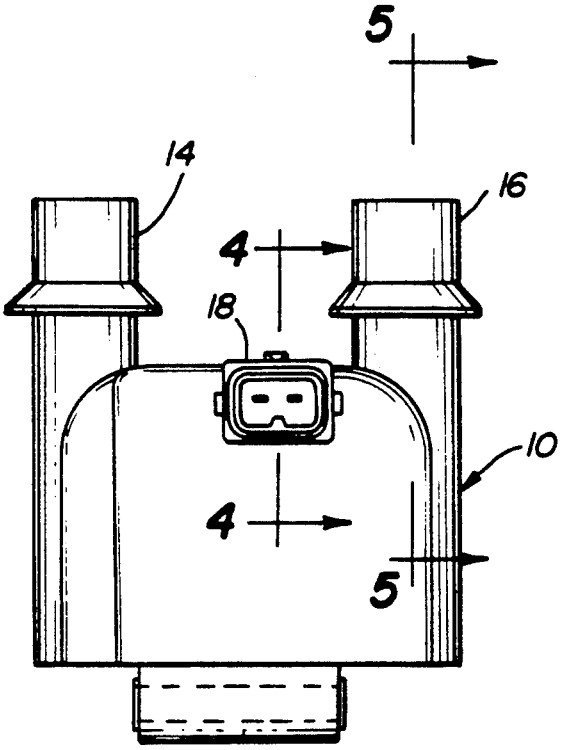
Fig-3
Fig-5
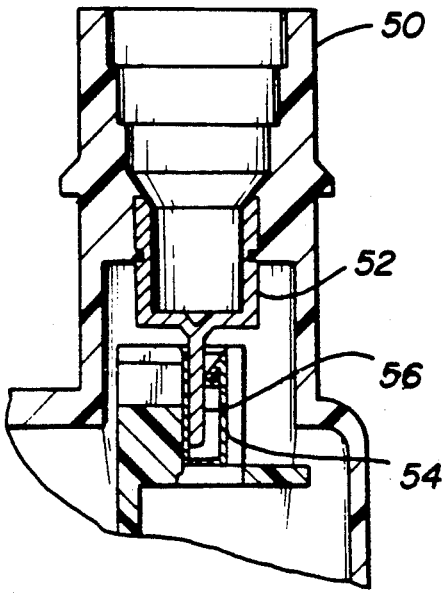

MODULAR TWIN TOWER DISTRIBUTORLESS IGNITION COIL

TECHNICAL FIELD

This invention relates to internal combustion engine ignition coil assemblies and more particularly to ignition coils for distributorless ignition systems.

BACKGROUND OF INVENTION

Ignition coils provide high voltage impulses to spark plugs of internal combustion engines. Conventional internal combustion engines utilize a distributor and single ignition coil to provide high voltage impulses to spark plugs in sequence determined by the distributor. The distributor included a mechanical rotor and a contact associated with each spark plug.

To meet fuel economy standards, exhaust emission standards and to extend maintenance intervals distributorless engine ignition systems have been developed. Distributorless systems have no moving parts which require replacement or adjustment. Instead, an electronic digital timing circuit sequences the impulses for engine spark plugs.

Twin tower ignition coils have been developed to allow two spark plugs to operate from one ignition coil. Positive and negative pulses from opposite ends of the coil fire on each input from the electronic timing circuit. In this arrangement, a spark is supplied via one tower to a spark plug when its associated cylinder is in the compression stroke and simultaneously provides a spark via the other tower to a spark plug with an associated cylinder in its exhaust stroke. An example of such a system is disclosed in U.S. Pat. No. 4,763,094 to Kojina which describes an ignition coil assembly for an internal combustion engine with four cylinders.

According to the Kojina patent the ignition coil assembly includes first and second primary and secondary coils embedded in a housing. The ignition coil assembly disclosed in Kojina is a bulky assembly. Electrical connections between the various coils and connector terminals require soldering at multiple points. Air gap tolerances and visual injection molding processes allow water entry into internal flux paths. The tolerance variability associated with manufacture of the steel core laminations (a stamping operation) complicates the injection molding process, which typically requires high-precision inserts. In addition, a small tolerance is necessary to establish an effective air gap in the magnetic flux path between the "C" lamination and laminated core embedded in the primary bobbin. These two effects taken together magnify variability in the production process and make insert molding of the laminations very difficult. The prior art (Kojina) could not address this variability and chose a more costly and complicated solution: the addition of two-layer mylar tape into the air gap described.

As a result of the above compromise employed by Kojina in the prior art, openings exist from the exterior of the housing to the encapsulated interior lamination. These can degrade over time causing an electrical "short" from the laminated core to the primary winding.

The ignition coil assembly disclosed in Kojina is a dedicated design intended only for use with a four cylinder engine. Use of such a coil assembly design would be inappropriate for a two cylinder engine. Four, six and eight cylinder engines would each require different assembly lines, additional tools and injection molds. Production costs are also adversely impacted by increasing the number of parts required to make different ignition coil assemblies for each engine.

DISCLOSURE OF INVENTION

According to the present invention a twin-tower ignition coil assembly is provided which is adapted to be individually or jointly attached with other coil assemblies and in turn to an internal combustion engine. When jointly connected to an engine, a plurality of coil assemblies are electrically and physically coupled by means of mating connectors in a modular fashion.

Each twin-tower coil assembly includes a molded housing, a primary winding, a secondary winding, a laminated steel plate armature, primary winding connectors and two high voltage towers for delivering the high voltage impulse induced by the secondary coil to respective engine spark plugs.

The primary winding connectors are connected to either an engine connector plug or to a mating socket on an adjacent ignition coil assembly. A common ground terminal is used by plural coil assemblies when linked together modularly. Positive control pulses are separately supplied to each coil to provide a high voltage impulse to the respective spark plugs in sequence.

One, two, three or even four ignition coil subassemblies can be coupled together by an end-to-end plug in connection for two, four, six or eight cylinder engines. Each modular ignition coil assembly is substantially identical in its overall configuration. Only minor modifications to the ignition coil assembly are required to tailor an ignition coil assembly to fit into its position in a series of modules.

Alternatively, one or more of the modules may be directly connected to the engine without being connected together physically in an end-to-end plug in configuration. Each module can be separately connected via connector to the engine spark control module which will control when the plugs are fired by the modular individual ignition coil assembly.

According to another aspect of the invention, a modular ignition coil assembly including a first ignition coil subassembly adapted to be connected to other ignition coil subassemblies is provided. Each ignition coil subassembly includes a standardized housing, an ignition coil within the housing having two high voltage towers through which current is provided to two engine spark plugs, primary winding connections from an inlet receptacle to the ignition coil. In all but the end ignition coil subassemblies, an outlet receptacle is provided for another ignition coil subassembly to be connected thereto.

BRIEF DESCRIPTION OF DRAWING

FIG. 2 is a front elevation view of the present invention.

FIG. 3 is side elevation view of the present invention.

FIG. 5 is a fragmentary cross-sectional view of the tower of a modular ignition coil assembly.

BEST MODE FOR CARRYING OUT INVENTION

Figure 1:
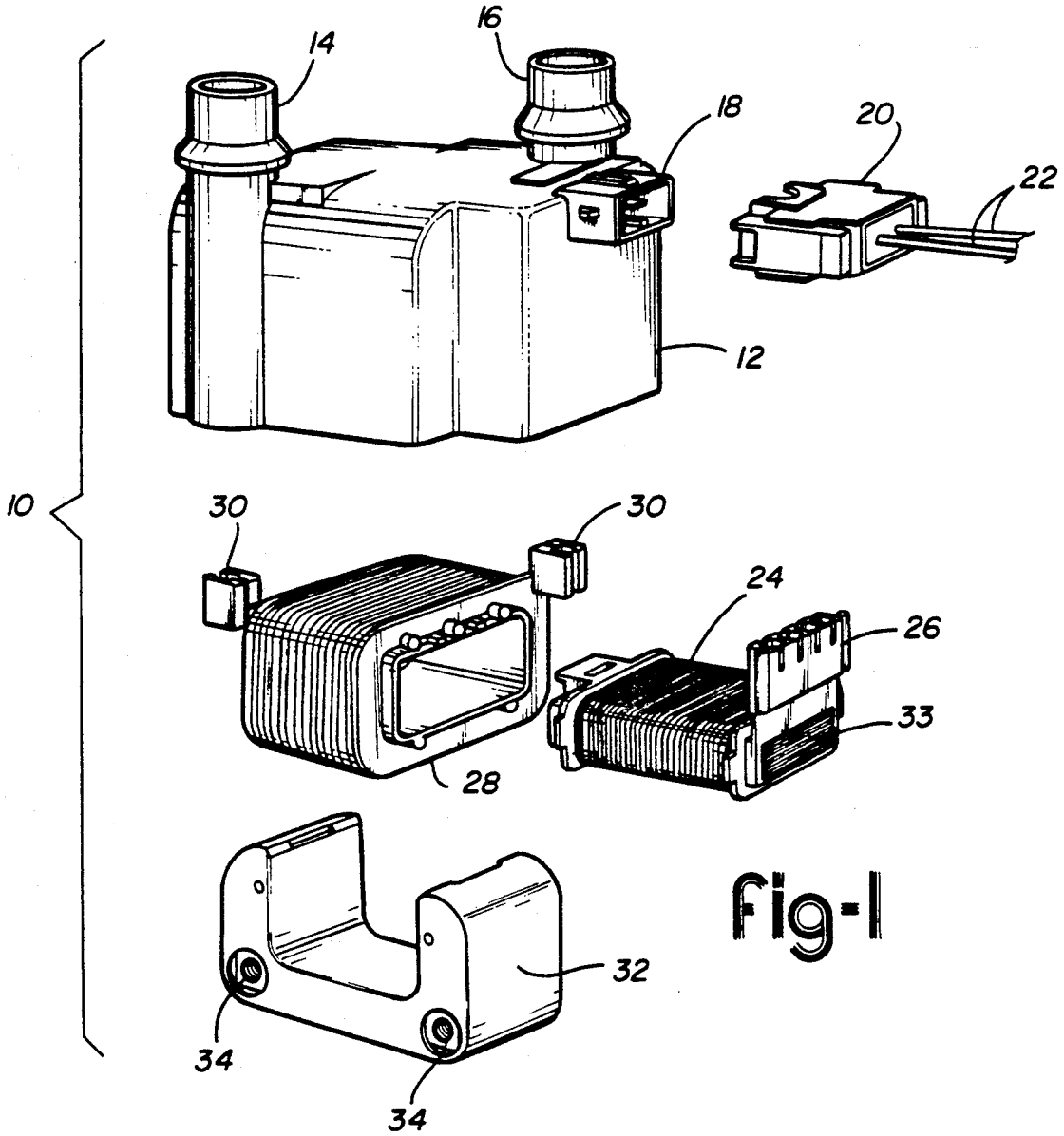
FIG. 1 is an exploded perspective view of a single module ignition coil assembly.

Referring now to FIGS. 1 through 3, a modular ignition coil assembly 10 made in accordance with the present invention is shown. The modular ignition coil assembly 10 includes a housing 12 comprising a hollow inverted cup-shaped member preferably formed of molded thermoplastic electrically insulating material. The interior of the housing is open from the bottom and is intended to be filled with an epoxy encapsulant. The epoxy encapsulant is selected to provide sufficient electric insulation and heat resistant properties.

First and second high voltage towers 14 and 16 extend upwardly from the housing 12. A receptacle 18 is preferably formed on one end of the housing 12. The receptacle 18 is adapted to receive a connector plug 20 as illustrated in FIG. 1. Connector plug 20 is connected by wires 22 to the engine control module which controls operation of the ignition coil assembly.

A primary bobbin 24 or primary coil winding, includes an integral primary coil terminal block 26. When an appropriate voltage is received from the engine ignition system, an electrical field is created about the primary bobbin 24. A secondary bobbin 28 or coil winding is disposed about the primary bobbin 24 which creates a high voltage output in response to the signal supplied to the primary bobbin 24. Secondary coil terminals 30 are provided on opposite ends of the secondary bobbin 28.

Laminated cores 32 and 33 are secured to the primary bobbin 24 and secondary bobbin 28 respectively to provide flux paths for the magnetic field formed by the bobbins. Mounting bores 34 may be formed through the laminated core 32 as shown in FIGS. 1, 2 and 3 or they may be formed as part of the housing 12. Fasteners (not shown) are received in the mounting bores 34 to allow the modular ignition coil assembly to be mounted in the engine compartment of the vehicle.

Figure 4:
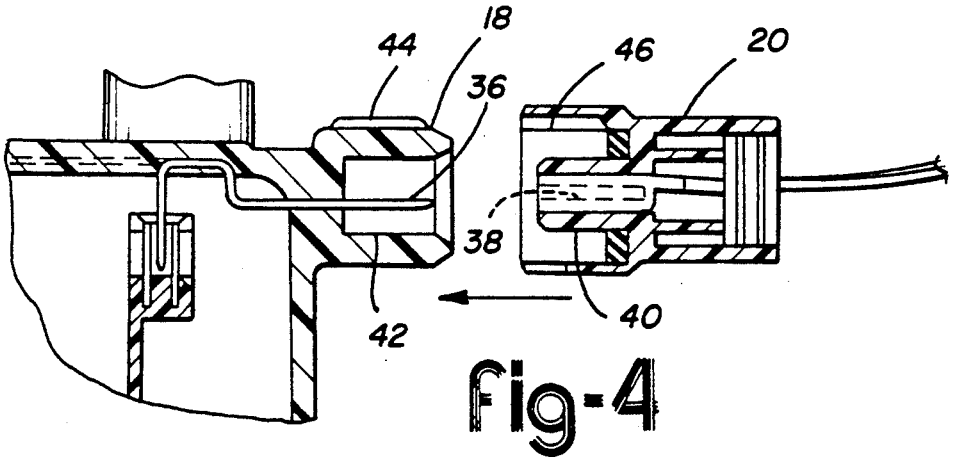
FIG. 4 is a fragmentary cross-sectional view showing a terminal and a receptacle formed on the housing of a modular ignition coil assembly.

Referring now to FIG. 4, the receptacle 18 and connector plug 20 of a modular ignition coil assembly 10 are shown in greater detail. The receptacle 18 includes a connector pin 36. Connector pin 36 is received in a connector clip 38 which is disposed in a connector plug shell 40 of the connector plug 20. Connector pins 36 are housed within a receptacle box 42 of the receptacle 18. Locking tabs 44 formed on the outside of the receptacle box 42 cooperate with locking elements 46 formed on the connector plug shell 40 to lock the connector plug 20 into the receptacle 18.

Referring now to FIG. 5, a cross-section of a high voltage tower connector receptacle 50 is shown. A high voltage contact seat 52 is provided at the base of the receptacle 50. The high voltage contact seat 52 is adapted to co-operate with a spark plug wire connector (not shown), to deliver high voltage impulses to respective spark plugs. A secondary winding terminal clip 54 engages a prong 56 which extends downwardly from the high voltage contact seat 52 so that an adequate electrical conduction path is provided from the secondary bobbin 28 to the high voltage connector receptacle 50.

Figure 6:
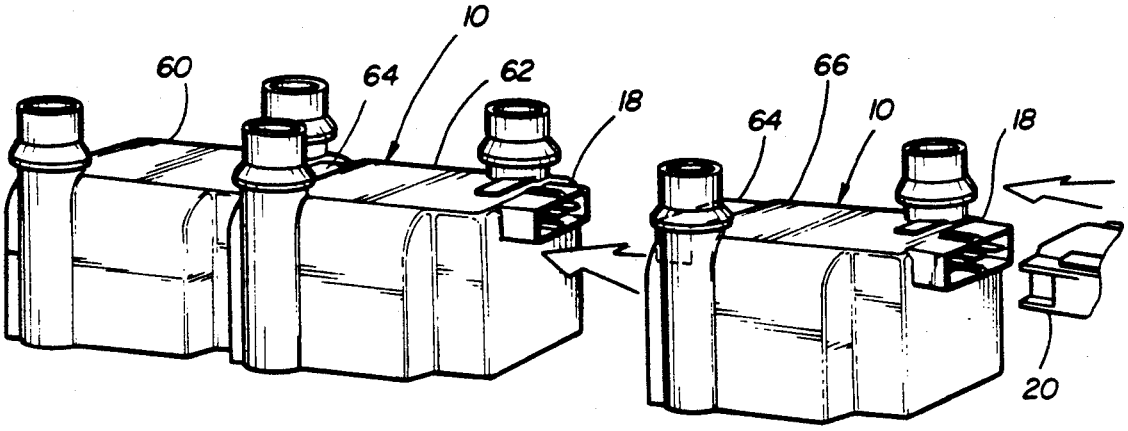
FIG. 6 is a perspective view showing a series of modules connected together according to the present invention.

Referring now to FIG. 6, a series of modular ignition coil assemblies 10 are shown as they would be connected together in an end-to-end fashion. An end module 60 is shown connected to a second module 62 by means of an inter-module connector plug 64. Inter-module connector plug 64 of the second module 62 connects to receptacle 18 of the end module 60. A third module 66 also includes an inter-module connector plug 64 which is received in receptacle 18 of the second module 62.

This modular approach can be repeated again to provide a series of four inter-connected modular ignition coil assemblies. Four modules would be required to fire a spark plug for an eight cylinder engine while the three module unit shown in FIG. 6 is adapted to fire six spark plugs of a six cylinder engine. Also shown at FIG. 6 is a connector plug 20 which is received in receptacle 18 of the third module 66.

Figure 7:
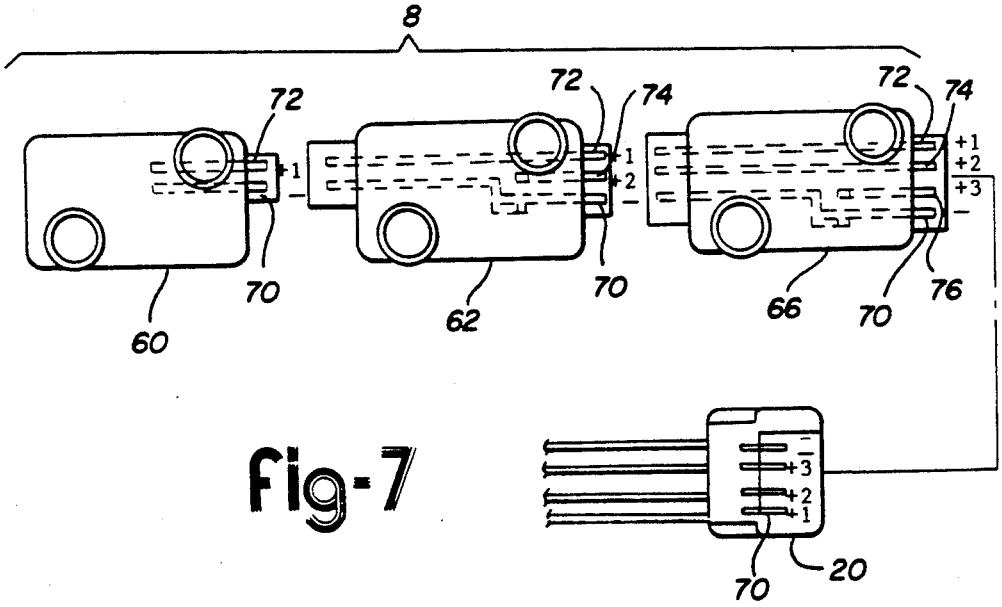
FIG. 7 is a schematic plan view showing a series of modules adapted to be connected together according to the present invention.

Referring now to FIG. 7, the electrical interconnection of three modules to a single connector plug is shown schematically. The connector plug and each of the modules include a common negative winding connection 70 which runs from the engine control module (not shown) through the connector plug 20, the third module 66, the second module 62 and finally terminates at the end coil module 60.

A first positive primary winding connection 72 provides a positive input to the end coil module and extends from the connector plug to the third module 66 and second module 62 prior to its termination at the end module 60. A second positive primary winding connection 74 provides the positive input for the second module 62 and extends from the connector plug 20 to the third module 66 prior to its termination at the second module 62. A third positive primary winding connection 76 provides a positive input to the third module 66 as received from the connector plug 20.

According to this arrangement, only a single connector plug 20 is required for three coils which are used to provide a high voltage impulse to six different spark plugs in an internal combustion engine. A minimal amount of soldering and assembly is required and substantially identical modular ignition coil assemblies can be fabricated with only minor modifications. Modifications to the receptacle 18 and primarily modification to the provision or omission of primary winding connections either through a module or terminating in a given module depending upon its planned position in the assembled modular ignition coils 10.

The above description is of preferred embodiments of the present invention. It will be readily appreciated by those of ordinary skill in the art that many modifications and variations are possible. The above specification should be read in an illustrative sense with the scope of the invention being interpreted in accordance with the following claims.

I claim:

1. A modular ignition coil assembly for an internal combustion engine comprising:

a first ignition coil subassembly further comprising:

a first housing;

a first ignition coil disposed within said first housing and having two high voltage towers through which current is provided to first and second engine spark plugs;

a positive primary winding connection to said first ignition coil;

a negative primary winding connection to said first ignition coil; and a first inlet receptacle integrally molded into said first housing having a pin for each of said positive and negative primary winding connectors;

a second ignition coil subassembly further comprising:

a second housing;

a second ignition coil disposed within said second housing and having two high voltage towers through which current is provided to third and fourth engine spark plugs;

a positive primary winding connection to said second ignition coil;

a negative primary winding connection to said second ignition coil; and a second inlet receptacle integrally molded into said second housing having a pin for each of said positive and negative primary winding connectors and having a pin connected to a bus in said housing; and a first outlet receptacle integrally molded into said second housing having a connection point for each of said pins of said first inlet receptacle; and a connector secured to a wiring harness electrically connecting an engine control module of said internal combustion engine to said second inlet receptacle.

2. A modular ignition coil assembly for an internal combustion engine comprising:

a first ignition coil subassembly further comprising:

a first housing;

a first ignition coil disposed within said first housing and having two high voltage towers through which current is provided to first and second engine spark plugs;

a positive primary winding connection to said first ignition coil;

a negative primary winding connection to said first ignition coil; and a first inlet receptacle integrally molded into said first housing having a pin for each of said positive and negative primary winding connectors;

a second ignition coil subassembly further comprising:

a second housing;

a second ignition coil disposed within said second housing and having two high voltage towers through which current is provided to third and fourth engine spark plugs;

a positive primary winding connection to said second ignition coil;

a negative primary winding connection to said second ignition coil; and a second inlet receptacle integrally molded into said second housing having a pin for each of said positive and negative primary winding connectors and having a pin connected to a bus in said housing; and a first outlet receptacle integrally molded into said second housing having a connection point for each of said pins of said first inlet receptacle; and a third ignition coil subassembly further comprising:

a third housing;

a third ignition coil disposed within said third housing and having two high voltage towers through which current is provided to fifth and sixth engine spark plugs;

a positive primary winding connection to said third ignition coil;

a negative primary winding connection to said third ignition coil; and a third inlet receptacle integrally molded into said third housing having a pin for each of said positive and negative primary winding connectors and having a pair of pins connected to a pair of buses in said housing; and a third outlet receptacle integrally molded into said third housing having a connection point for each of said three pins of said second inlet receptacle; and a connector secured to a wiring harness electrically connecting an engine control module of said internal combustion engine to said third inlet receptacle.

3. A modular ignition coil system for an internal combustion engine comprising:

a plurality of induction coil subassemblies each having a housing, a primary coil, a secondary coil, a pair of primary connectors and a pair of high voltage towers, one of said induction coil subassemblies is an end subassembly and at least one of said induction coil subassemblies is an intermediate subassembly;

a first connector formed on each of said intermediate subassemblies, said first connector having a positive conductor pin for each of said plurality of induction coil subassemblies and a common negative conductor pin electrically connected to all of said induction coil subassemblies with one of said positive conductor pins feeding the induction coil of its respective subassembly, and said other positive conductor pins being connected through a separate bus from said other pins each to another of said induction coils of said induction coil subassemblies;

a second connector formed on said intermediate subassemblies for receiving a first connector of an adjacent induction coil subassembly, said second connector receptacle having conductor pins for said common negative conductor and positive connector pins for feeding the induction coil of its respective subassembly and each of said induction coils between it and said end subassembly and including the coil of said end subassembly each through a separate bus.

* * * * *